US007069716B1

(12) United States Patent
Childers

(10) Patent No.: US 7,069,716 B1
(45) Date of Patent: Jul. 4, 2006

(54) COOLING AIR DISTRIBUTION APPARATUS

(75) Inventor: Philip Childers, Tulsa, OK (US)

(73) Assignee: Express Integrated Technologies LLC, Tulsa, OK (US)

( * ) Notice: Subject to any disclaimer, the term of this patent is extended or adjusted under 35 U.S.C. 154(b) by 139 days.

(21) Appl. No.: 10/887,125

(22) Filed: Jul. 8, 2004

Related U.S. Application Data

(63) Continuation-in-part of application No. 10/131,420, filed on Apr. 24, 2002, now abandoned.

(51) Int. Cl.
*F02C 7/141* (2006.01)

(52) U.S. Cl. ..... 60/39.5

(58) Field of Classification Search ..... 60/39.182, 60/39.5, 772; 122/7 B, 7 R
See application file for complete search history.

(56) References Cited

U.S. PATENT DOCUMENTS 2,358,690 A * 9/1944 Decker ..... 417/179
4,149,453 A * 4/1979 Reed ..... 454/43
4,706,612 A * 11/1987 Moreno et al. ..... 60/39.182
4,811,555 A * 3/1989 Bell ..... 60/39.182
4,930,305 A * 6/1990 Bell ..... 60/39.5
5,224,334 A * 7/1993 Bell ..... 60/274
5,632,143 A * 5/1997 Fisher et al. ..... 60/39.182
6,055,803 A * 5/2000 Mastronarde ..... 60/39.182
6,298,655 B1 * 10/2001 Lee et al. ..... 60/39.182

* cited by examiner

*Primary Examiner*—Ted Kim
(74) *Attorney, Agent, or Firm*—LaRiviere, Grubman & Payne, LLP

(57) ABSTRACT

An apparatus for the distribution of cooling air having a cooling air distribution housing having an exterior wall, an interior wall, an inlet end and an outlet end defining a substantially circular passage therethrough, a cooling air providing assembly provides cooling air to the cooling air distribution housing and a plurality of cooling air distribution conduits before proving passage of the cooling air from the cooling air distribution housing into the substantially circular passage. Each of the plurality of cooling air distribution conduits having an inflow end and communication with the cooling air distribution housing and an outflow end extending into the substantially circular passage.

16 Claims, 4 Drawing Sheets

COOLING AIR DISTRIBUTION APPARATUS

REFERENCE TO PENDING APPLICATIONS

This application is a continuation-in-part of U.S. patent application Ser. No. 10/131,420 filed on 24 Apr. 2002 entitled TEMPERING AIR DISTRIBUTION APPARATUS now abandoned.

REFERENCE TO MICROFICHE APPENDIX

This application is not referenced in any microfiche appendix.

FIELD OF THE INVENTION

The present invention is generally directed toward an apparatus for the distribution of cooling air. More specifically the present invention is directed toward an apparatus for the distribution of cooling air used in connection with a system for power generation utilizing a gas turbine engine.

BACKGROUND OF THE INVENTION

Turbine engines are utilized in various industries, such as the power-producing industry. These turbine engines, however, produce a stream of exhaust gas otherwise known as flue gas which contain components which are harmful to the atmosphere, such as oxides of nitrogen (NOx). To reduce the amount of these harmful components within the flue gas stream various procedures and apparatus have been developed. These processes typically involve passing the flue gas across a catalyst which has a reducing effect on the harmful components contained therein.

As part of these processes, often the introduction of cooling or cooling air is introduced into the flue gas stream. The cooling air acts to reduce the temperature of the flue gas to protect the effectiveness and efficiency of the subsequently utilized catalyst. The introduction of the cooling air, however, is in a non-homogeneous manner which can cause the flue gas stream to have non-uniform temperature zones, including zones of excessive high flue gas temperatures. These high flue gas temperature zones can ruin the effectiveness and longevity of the catalyst. Thus, it is critical that the cooling air be fully, i.e. homogeneously, mixed with the flue gas.

The prior art typically used for the introduction of cooling air into the flue gas stream includes the use of a rectangular-shaped grid having a series of pipes or jets for the introduction of the cooling air. This grid structure, however, has disadvantages. The flue gas discharge of the turbine engines used is circular in nature; and thus, create a swirling stream of flue gas. Introduction of the swirling stream into a rectangular-shaped cooling air grid is not effective in that parts of the grid do not come in contact with the flue gas stream while other parts of the grid are overwhelmed by the flue gas stream, thus simultaneously underwhelming and overwhelming the system.

Thus, there is a need for a cooling air system which is more effective and efficient for the introduction of cooling air into a swirling stream of flue gas.

BRIEF SUMMARY OF THE INVENTION

The present invention satisfies the need discussed above. The present invention is generally directed toward an apparatus for the distribution of cooling air. More specifically, the present invention is directed toward an apparatus for the distribution of cooling air within a process for the generation of power utilizing a gas turbine engine.

In one aspect, the present invention provides for the introduction of cooling, or cooling, air into flue, or exhaust, gas being emitted from a turbine engine through an assembly configured to introduce the cooling air substantially inline with the exhaust gas.

In this aspect, a cooling air distribution apparatus is contained within a turbine engine exhaust system. Within this system is a turbine engine producing an exhaust gas flow having a temperature along with one or more downstream catalyst to reduce the harmful components contained within the exhaust gas. The apparatus of the present invention is located between the turbine engine and the one or more downstream catalyst. Unaltered, the temperature of the exhaust gas is excessive high which ruins the catalyst's effectiveness.

In this aspect, the cooling air distribution apparatus includes a cooling air distribution housing, a cooling air providing assembly and a plurality of cooling air distribution conduits. The cooling air distribution housing has an inlet end, an outlet end and a substantially circular wall therebetween which defines a substantially circular passage. This passage allows the exhaust gas flow to travel from the turbine engine to the catalyst. The cooling air providing assembly is in communication with the cooling air distribution housing, providing cooling air to the housing. One aspect of the cooling air providing assembly which includes a fan/blower structure, a cooling air inlet duct which is in communication with the fan/blower structure and with the cooling air distribution housing for facilitating the cooling air from the fan/blower structure to the cooling air distribution housing.

The cooling air has a temperature which is lower than the temperature of the exhaust gas flow such that the exhaust gas flow is cooled to an appropriate temperature to maintain the catalyst's performance characteristics.

The plurality of cooling air distribution conduits extend through the substantially circular wall of the cooling air distribution housing and into the substantially circular passage. Each of the conduits provide passage for the cooling air into enter into the substantially circular passage. The cooling air is homogeneously mixed with the exhaust gas flow. Due to the lower temperature of the cooling air, the exhaust gas flow is cooled to an appropriate temperature to maintain the catalyst's performance characteristics.

The cooling air distribution conduits can take on various characteristics including a nozzle having an orifice, or an inflow end, and outflow end and an approximately 90° bend between said inflow end and said outflow end, or can be aligned at an angle of approximately 45° from a central axis of the cooling air distribution housing. The conduits can also be aligned substantially uniform in one or more rows around the circumference of the wall of the cooling air distribution housing. Further, the conduits can be aligned approximately inline with a stream of exhaust gas which enters the cooling air distribution housing.

In another aspect of the present invention, the cooling air distribution housing includes a substantially circular exterior wall, a substantially circular interior wall and two side walls therebetween defining an annular chamber. The substantially circular interior wall defines the substantially circular passage. The cooling air providing assembly is in communication with the exterior wall and provides the cooling air into the annular chamber. The plurality of cooling air distribution conduits extend from the annular chamber through the interior wall and into the passage to provided passage for the cooling air into the passage.

One aspect of the method of the present invention includes homogeneously mixing cooling air into the exhaust gas flow downstream of the turbine engine and upstream of the one or more catalyst.

Further objects and features of the present invention will be apparent to those skilled in the art upon reference to the accompanying drawings and upon reading the following description of the preferred embodiments.

DETAILED DESCRIPTION OF THE PREFERRED EMBODIMENTS

Figure 1:
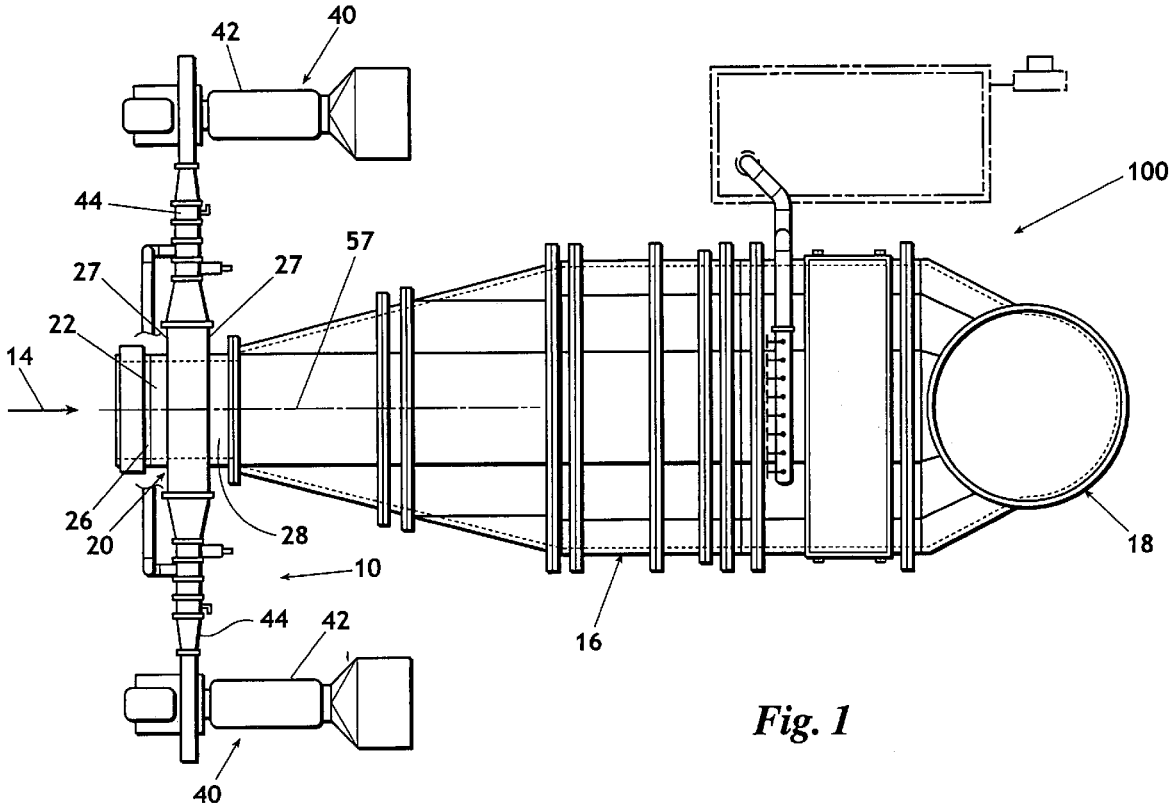
FIG. 1 is a top perspective view of a power plant exhaust duct system incorporating an embodiment the inventive cooling air system contained therein.

As illustrated in the figures, an embodiment of the present invention is disclosed. As shown in FIG. 1, an embodiment of the cooling air distribution apparatus 10 of the present invention is disclosed in connection with an exhaust gas duct apparatus 100 which is utilized in a power plant. A stream of flue, or exhaust, gas 14, is created by a turbine engine (not shown) which contains harmful components, such as NOx, enters the exhaust gas apparatus 100 and passes through the inventive cooling air distribution apparatus 10 and remaining portions of the duct apparatus 16, which contain various processes, such as one or more catalysts, for the reduction of the harmful components before entering into a stack 18 which allows the flue gas to exit into the atmosphere. However, unaltered, the temperature of the exhaust gas 14 is excessive high which ruins the catalyst's 16 effectiveness.

In this invention, the terms flue gas and exhaust gas are meant to be interchangeable and refer to the flow which is emitted from the turbine engine system that provides power for the power plant. Further, the terms tempering or cooling refer to the same type of air which is used to cool the temperature of the exhaust gas emitted from the turbine engine.

In the embodiment shown in the figures, cooling air distribution apparatus 10 is located downstream of the turbine engine and upstream of the one or more downstream catalyst 16 and comprises a cooling air distribution housing 20 which is configured to define a substantially circular passageway 30, a cooling air providing assembly 40 which provides cooling air to cooling air distribution housing 20 and a plurality of cooling air distribution conduits 50 to facilitate the passage of the cooling air 12 into the substantially circular passage 30.

One embodiment of the cooling air distribution housing 20 comprises an exterior wall 22, an interior wall 24, two end walls 27 therebetween which define an annular chamber 60, and define a substantially circular passage 30 having an inlet end 26 and an outlet end 28. This passage 30 allows the exhaust gas 14 to travel from the turbine engine to the one or more catalysts 16.

Figure 2:
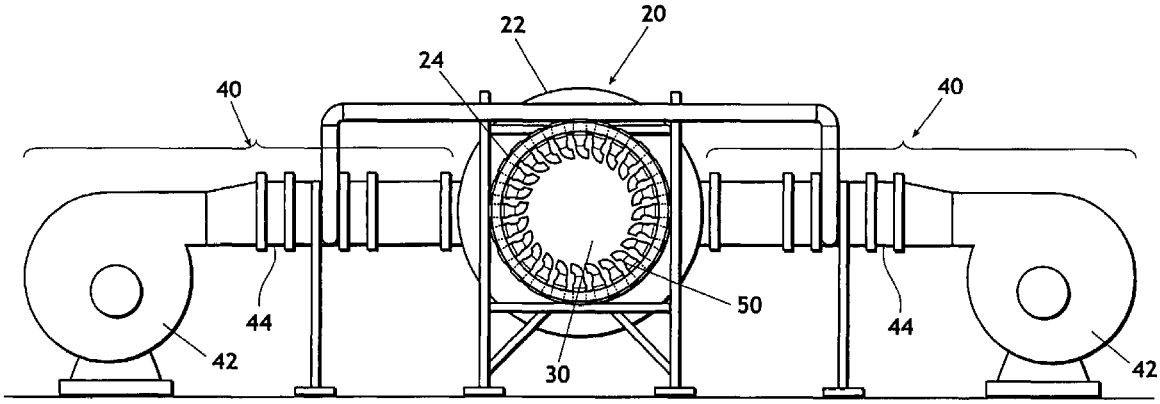
FIG. 2 is a cross-sectional front perspective view of an embodiment of the inventive cooling air system.

As illustrated in FIG. 2, an embodiment for the cooling air providing assembly 40 is illustrated. The cooling air providing assembly 40 is in communication with the cooling air distribution housing 20 and provides cooling air 12 to the housing 20. This embodiment illustrates a fan blower 42 connected to a cooling air inlet duct 44 which itself is connected to cooling air distribution housing 20. In operation, cooling air 12 is pulled within the fan blower structure 42 and traverses through cooling air inlet duct 44 and into annular chamber 60, which is then dispersed into the substantially circular passage 30 via the cooling air distribution conduits 50. Cooling air 12 is homogeneously mixed with the exhaust gas 14. Due to the cooling air 12 having a lower temperature than the temperature of the exhaust gas flow 14, the exhaust gas flow 14 is cooled to an appropriate temperature to maintain the catalyst's 16 performance characteristics.

While two cooling air providing assembly 40 are shown, those skilled in the art will recognize and appreciate that one or more fan blower assemblies could be used with the present invention. Further, it can be appreciated that the fan blower assemblies can be located on one or more sides of the cooling air distribution housing 20. The representation of two cooling air providing assembly 40, with one located on each side of the cooling air distribution housing 20 is merely illustrative and is not limiting.

Each of the plurality of cooling air distribution conduits 50 have an inflow end 52 and an outflow end 54. Inflow end 52 is attached to the interior wall 24 of the cooling air distribution housing 20 and is in communication with the annular chamber 60 such that the cooling air 12 can pass from the annular chamber 60 into the cooling air distribution conduit 50 through its inflow end 52. Outflow end 54 extends into the substantially circular passage 30 and allows for the cooling air 12 to enter therein.

Figure 3:
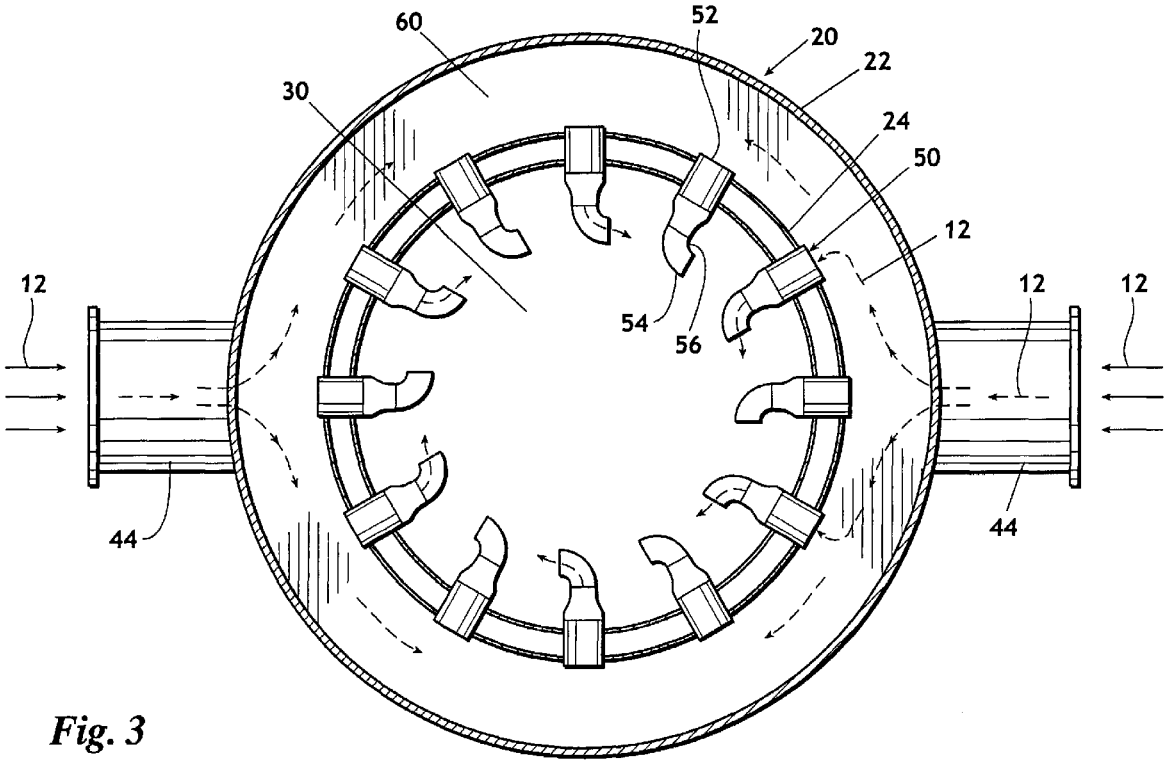
FIG. 3 is a cross-sectional front view of an embodiment of the cooling air distribution housing of the present invention.

As shown in particular FIG. 3, an embodiment of the cooling air distribution conduit 50 is a pipe having an inflow end 52, an outflow end 54 and having a 90° bend 56 therebetween. Those skilled in the art would understand and appreciate that the cooling air distribution conduit 50 can be created in other various geometrical designs. The one depicted is for illustrative purposes only and is not meant as a limitation.

The plurality of the cooling air distribution conduits 50 are arranged uniformly along the interior wall 24 of the cooling air distribution housing 20. Additionally, the outflow end 54 of each of the cooling air distribution conduits 50 is aligned at an effective angle 58 from the center line axis 57 of the substantially circular passage 30. The effective angle 58 is an angle that approximately matches the swirling effect the stream of flue gas 14 as it enters into the substantially circular passage 30 from the turbine engine (not shown). By aligning the outflow end 54 of the cooling air distribution conduits 50 to be substantially in line with the stream of flue gas 14, the effectiveness of the introduction of cooling air 12 is increased. While it has been found that an effective angle 58 equaling 45° is effective for the distribution of cooling air 12, those skilled in the art would understand and appreciate that other angles can be effective for the effective angle 58. The one depicted is for illustrative purposes only and is not meant as a limitation.

Figure 4:
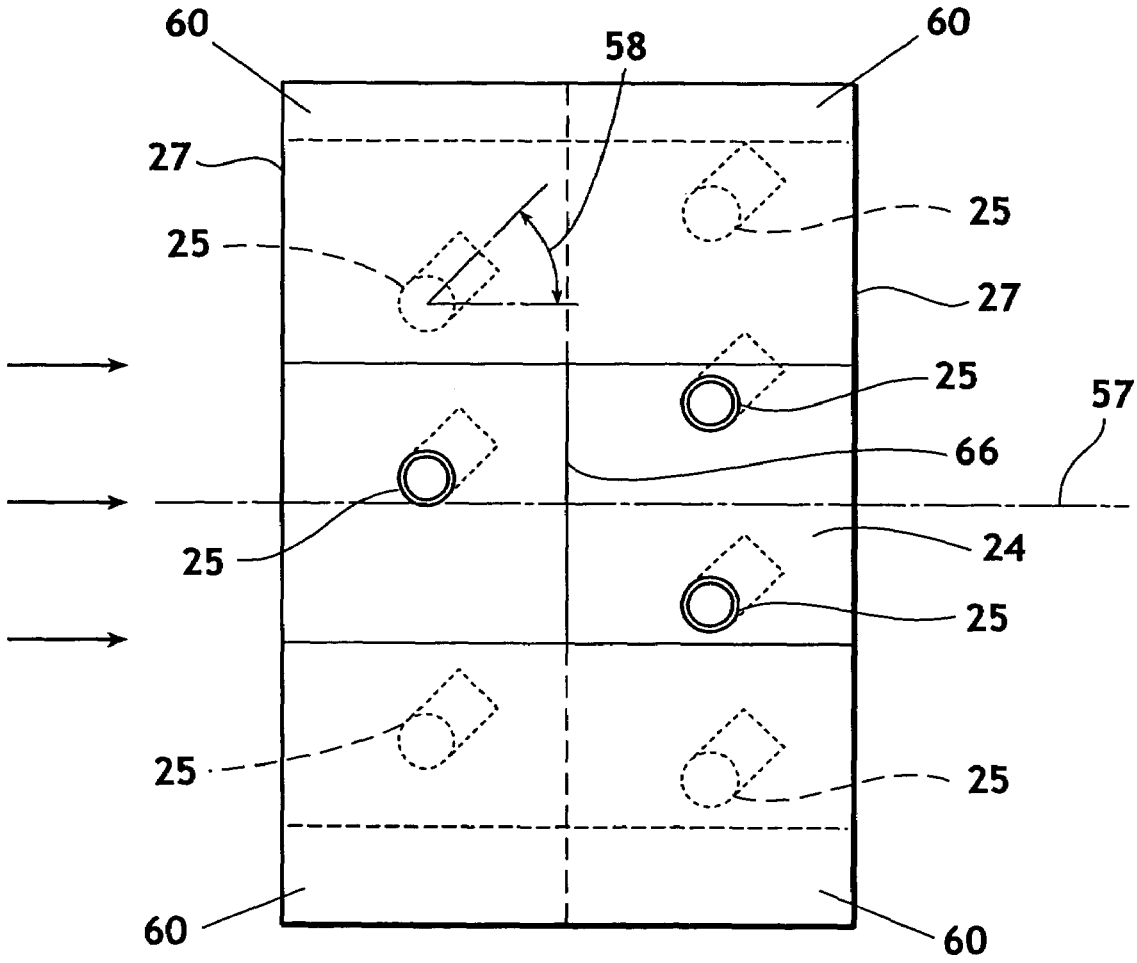
FIG. 4 is a cross-sectional side view of an embodiment of the cooling air distribution housing of the present invention.

As illustrated in FIG. 4, an embodiment of cooling air distribution housing 20 illustrates a divider 66 creating two annular chambers 60. Each annular chamber 60 has a single row of cooling air distribution conduits in communication thereof. Additionally, each annular chamber has a dedicated cooling air providing assembly 40. While FIG. 4 illustrates cooling air distribution housing 20 having two annular chambers 60, those skilled in the art would recognize that multiple annular chambers can be created. Additionally, those skilled in the art would appreciate that more than one row of cooling air distribution conduit can be associated with each annular chamber 60. The single row for each annular chamber is merely illustrative and is not limiting. Additionally, FIG. 4 illustrates that each annular chamber 60 has a cooling air providing assembly 40. Those skilled in the art would recognize that a single cooling air providing assembly 40 could provide cooling air 12 to one or more annular chambers 60. The use of a single cooling air providing assembly 40 to each annular chamber 60 is merely illustrative and is not limiting.

In operation, the stream of exhaust gas 14 enters into the substantially circular passage 30 of the cooling air distribution housing 20 through inlet end 26. While the stream of exhaust gas 14 is passing through the substantially circular passage 30 cooling air 12 is introduced into the substantially circular passage 30 through each of the cooling air distribution conduits 50 causing the stream of exhaust gas 14 and the cooling air 12 to homogeneously mix. The stream of exhaust gas 14 then exits through the outlet end 28. Due to the cooling air 12 having a lower temperature than the temperature of the exhaust gas flow 14, the exhaust gas flow 14 is cooled to an appropriate temperature to maintain the one or more catalyst's 16 performance characteristics While the invention has been described with a certain degree of particularity, it is understood that the invention is not limited to the embodiments set forth herein for purposes of exemplification, but is to be limited only by the scope of the attached claims or including the full range of equivalency to which each element thereof is entitled.

What is claimed is:

1. A cooling air distribution apparatus contained within a turbine engine exhaust system in communication with, and downstream of, a turbine engine producing an exhaust gas flow having a first temperature and upstream of a catalyst, wherein said first temperature of said exhaust gas is of such a high temperature that the performance and longevity of said catalyst is reduced, said apparatus comprising:

a cooling air distribution housing having an inlet end, an outlet end and a substantially circular wall therebetween defining a substantially circular passage to allow said exhaust gas flow to travel from said turbine engine and to said catalyst;

a plurality of cooling air distribution conduits extending through said substantially circular wall and into said substantially circular passage, each of said plurality of cooling air distribution conduits providing passage for cooling air having a second temperature into said substantially circular passage to homogeneously mix with said exhaust gas flow, said second temperature of said cooling air being lower than said first temperature of said exhaust gas flow such that said exhaust gas flow is cooled to an appropriate temperature to maintain said catalyst's performance characteristics; and a cooling air providing assembly in communication with said cooling air distribution housing providing said cooling air to each of said plurality of cooling air distribution conduits.

2. The cooling air distribution apparatus of claim 1 wherein said cooling air providing assembly comprises a fan/blower structure, a cooling air inlet duct in communication with said fan/blower structure and with said cooling air distribution housing for facilitating said cooling air from said fan/blower structure to said cooling air distribution housing.

3. The cooling air distribution apparatus of claim 1 wherein each of said plurality of cooling air distribution conduits comprises a nozzle having an orifice.

4. The cooling air distribution apparatus of claim 1 wherein each of said plurality of cooling air distribution conduits comprises an inflow end, and outflow end and an approximately 90° bend between said inflow end and said outflow end.

5. The cooling air distribution apparatus of claim 1 wherein said cooling air distribution housing comprises a substantially circular exterior wall, a substantially circular interior wall and two side walls therebetween defining an annular chamber, said substantially circular interior wall defining a substantially circular passage, said cooling air providing assembly in communication with said substantially circular exterior wall providing cooling air to said annular chamber; said plurality of cooling air distribution conduits extend from said annular chamber through said substantially circular interior wall and into said substantially circular passage to provided passage for said cooling air into said substantially circular passage.

6. The cooling air distribution apparatus of claim 1 wherein said cooling air distribution housing is defined as having a central axis running therethrough, and each of said plurality of cooling air distribution conduits is aligned approximately inline with a stream of flue gas which enters said inlet end of said cooling air distribution housing.

7. The cooling air distribution apparatus of claim 6 wherein each of said plurality of cooling air distribution conduits is aligned at an angle of approximately 45° from said central axis.

8. The cooling air distribution apparatus of claim 1 wherein said plurality of cooling air distribution conduits is further defined being aligned substantially uniform in one or more rows around the circumference of said interior wall of said cooling air distribution housing.

9. The cooling air distribution apparatus of claim 8 wherein each of said plurality of cooling air distribution conduits is further defined as being a nozzle having an orifice.

10. The cooling air distribution apparatus of claim 8 wherein said cooling air distribution housing is further defined as having a central axis running therethrough, and each of said plurality of cooling air distribution conduits is aligned approximately inline with a stream of flue gas which enters said inlet end of said cooling air distribution housing.

11. The cooling air distribution apparatus of claim 10 wherein said plurality of cooling air distribution conduits are further defined as being aligned at an angle of approximately 45° from said central axis.

12. A cooling air distribution apparatus contained within a turbine engine exhaust system in communication with, and downstream of, a turbine engine producing an exhaust gas flow having a first temperature and upstream of a catalyst, wherein said first temperature of said exhaust gas is of such a high temperature that the performance and longevity of said catalyst is reduced, said apparatus comprising:

a cooling air distribution housing having an inlet end, an outlet end and a substantially circular exterior wall therebetween, a substantially circular interior wall defining an annular chamber, said substantially circular interior wall defining a substantially circular passage, substantially circular wall therebetween defining a substantially circular passage to allow said exhaust gas flow to travel from said turbine engine and to said catalyst;

a cooling air providing assembly in communication with said cooling air having a second temperature distribution housing providing cooling air to said annular chamber; and a plurality of cooling air distribution conduits extending from said annular chamber through said substantially circular interior wall and into said substantially circular passage and being aligned substantially uniform in one or more rows around the circumference of said interior wall of said cooling air distribution housing, each of said plurality of cooling air distribution conduits providing passage for said cooling air into said substantially circular passage to homogeneously mix with said exhaust gas flow, said second temperature of said cooling air being lower than said first temperature of said exhaust gas flow such that said exhaust gas flow is cooled to an appropriate temperature to maintain said catalyst's performance characteristics.

13. The cooling air distribution apparatus of claim 12 wherein said cooling air distribution housing is further defined as having a central axis running therethrough, and each of said plurality of cooling air distribution conduits is aligned approximately inline with a stream of flue gas which enters said inlet end of said cooling air distribution housing.

14. The cooling air distribution apparatus of claim 12 wherein said plurality of cooling air distribution conduits are further defined as being aligned at an angle of approximately 45° from said central axis.

15. The cooling air distribution apparatus of claim 12 wherein said cooling air providing assembly comprises a fan/blower structure, a cooling air inlet duct in communication with said fan/blower structure and with said cooling air distribution housing for facilitating said cooling air from said fan/blower structure to said cooling air distribution housing.

16. The cooling air distribution apparatus of claim 12 wherein each of said plurality of cooling air distribution conduits comprises an inflow end, and outflow end and an approximately 90° bend between said inflow end and said outflow end.

* * * * *